United States Patent [19]

Lindenmeier et al.

[11] Patent Number: 4,791,426

[45] Date of Patent: Dec. 13, 1988

[54] ACTIVE ANTENNA IN THE REAR WINDOW OF A MOTOR VEHICLE

[75] Inventors: Heinz Lindenmeier, Planegg; Gerhard Flachenecker, Ottobrunn, both of Fed. Rep. of Germany

[73] Assignee: Hans Kolbe & Co., Bad Salzdetfurth, Fed. Rep. of Germany

[21] Appl. No.: 715,644

[22] Filed: Mar. 21, 1985

[30] Foreign Application Priority Data

Mar. 21, 1984 [DE] Fed. Rep. of Germany ..... 3410415

[51] Int. Cl.[4] ..... H01Q 1/32

[52] U.S. Cl. ..... 343/713

[58] Field of Search ..... 343/711, 713

[56] References Cited

U.S. PATENT DOCUMENTS 4,439,771 3/1984 Kume et al. ..... 343/713

*Primary Examiner*—William L. Sikes

*Assistant Examiner*—Robert E. Wise

*Attorney, Agent, or Firm*—Michael J. Striker

[57] ABSTRACT

An active antenna for the reception of long-, medium-, short-and ultra-short wave broadcasts is arranged in a rear window of a motor vehicle equipped with a boundary conductor enclosing an array of heating elements. The reception of long-, medium- and short-wave signals is made by means of an elongated flat antenna element which is arranged in the window on a free area above or below the heating elements, and the reception of the ultra-short wave signals is effected by the array of heating elements. An antenna amplifier includes a linear amplifying stage connected to the flat antenna element, an amplifying branch circuit connected to the array of heating elements and a common ground terminal connected to the boundary conductor. A frequency separator has two inputs connected, respectively, to the output of the amplifying stage and of the branch circuit, and an output connected via an antenna cable to a conventional radio receiver.

26 Claims, 6 Drawing Sheets

ACTIVE ANTENNA IN THE REAR WINDOW OF A MOTOR VEHICLE

BACKGROUND OF THE INVENTION

The present invention relates in general to an active antenna for the reception of long, medium, short and ultra-short wave broadcasts and being mounted on an electrically heated rear window of a motor vehicle. The heated rear window is equipped with a set of heating elements connected via bus bars to direct current power connections and including also connections to an antenna amplifier.

In designing antennas of this kind it is necessary to obtain an optimum reception both in the long, medium and short wave range and in the ultra-short wave range and also to prevent a pick-up of high frequency interferences, for example from the network of the motor vehicle.

An antenna of this kind is known for example from the German application P No. 26 50 044. In this known antenna the set of heating elements serves simultaneously as an antenna element for the reception both of the short, medium and short waves and for ultra-short wave signals. In this design, there is a problem particularly in the supply of direct current for the heating elements. Especially in the long, medium and short wave range in which the set of heating elements due to relatively low frequencies constitutes a high impedence antenna element, the supply of large direct currents necessary for heating the window causes a considerable damping of the received signals. In the prior art solution, the heating direct currents are supplied through a bifilar choke or reactance coil whereby the choke is connected for high frequency signals parallel to the antenna element. Especially at low frequencies however it is not possible to set the reactance of the choke to a sufficiently high value to match the broad band of the L-M-S wave range so that the parallel connection of the choke to the antenna do not markedly impair the reception of the signal. In the ultra-short wave range in which the set of heating elements represents a substantially low impedance antenna element, the choking of the direct current supply can be substantially simpler and without expensive technological measures.

Accordingly, in contrast to the L-M-S range the reception of ultra-short wave signals by the antenna according to P No. 26 50 044 is satisfactory. Another disadvantage of this prior art antenna however is interference from coupling to the receiver input, particularly at lower frequencies. The high frequency interferences are generated by electrical systems in the motor vehicle for example due to ignition and fuel injection control pulses. Inasmuch as the antenna according to P No. 26 50 044 has its antenna element connected both to the input of a receiver and in the case of a turned-on rear window heating, also to an electrical power supply in which is disturbed by high frequency interferences, there are necessary highly effective filtering means particularly for the relatively low frequency L-M-S wave range in order to avoid disturbances at the input of the receiver. The technical expenditures for the provision of such filtering devices, due to high intensity of heating currents (up to about 30 A) are considerable.

A similar antenna is known also from the application P No. 23 60 672. This known antenna is possessed with similar disadvantages.

SUMMARY OF THE INVENTION

It is therefore a general object of this invention to avoid the disadvantages of prior art antennas of this kind.

In particular, it is an object of this invention to provide an antenna installable in the heated rear window of a motor vehicle which guarantees a good reception quality both in the ultra-short wave band and in the long, medium and short wave band.

Another object of this invention is to provide such an improved antenna which requires minimum expenditures for filtering the low frequency interferences from the heating circuit.

In keeping with these objects and others which will become apparent here after, one feature of this invention resides, in an antenna system arranged in a heated rear window of a motor vehicle provided with a boundary conductor and a set of heating elements connected via bus bars to direct current power connections, in the provision of an elongated, flat antenna element mounted in the window between the set of heating elements and the boundary conductor to receive long, medium and short wave signals, the flat antenna having a transverse dimension which is adjusted for optimizing recieved signals; a low noise linear amplifier of a high capacitive input impedance, the amplifier including a first amplifying stage for the long, medium and short wave signals, a second signal processing stage for ultra-short wave signals, and a common ground terminal, an input of the first stage being connected to the flat antenna element by a short conductor and the common ground terminal being connected by another short conductor to the boundary conductor; a frequency separator having two inputs connected respectively to outputs of the first and second amplifier stages, and an output connected to an antenna connector; and means for coupling an input of the second amplifier stage to a conductor in the window acting as an antenna element for the ultra-short wave signal. The input of the second amplifying stage is connected to one end of the bus bar of the heating elements and the coupling means include a reactance circuit passing through direct current and connected to the other end of the bus bar and the connection for the direct current supply. In a modification the input of the second amplifying element is coupled to the elongated flat antenna element.

The novel features which are considered as characteristic for the invention are set forth in particular in the appended claims. The invention itself however both as to its construction and its method of operation, together with additional objects and advantages thereof, will be best understood from the following description of specific embodiments when read in connection with the accompany drawing.

DESCRIPTION OF THE PREFERRED EMBODIMENTS

Figure 1:
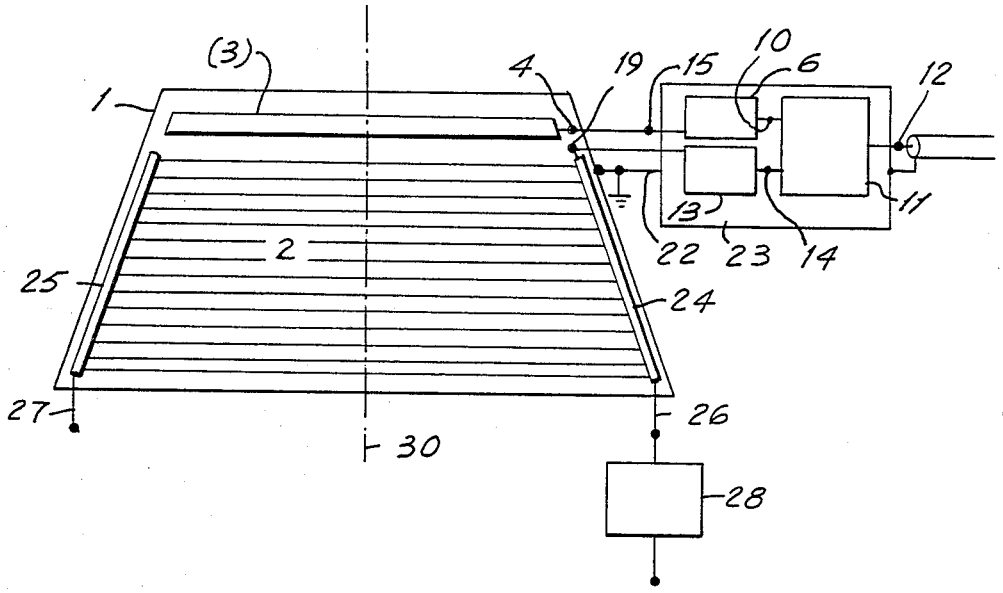
FIG. 1 is a schematic block circuit diagram of an embodiment of the antenna of this invention with a coupling of ultra-short wave signals to the set of heating elements.

The embodiments illustrated in the drawings achieve, in comparison to prior art antennas of this kind a better reception in the long-medium-short wave range and a reduction of interferences which are induced in the receiver system via the direct current supply to the set of heating elements. Moreover, due to the galvanic separation of the long-medium-short wave antenna element 3 from the set of heating elements 2 it is no longer necessary to separate for a high frequency range the heating elements from the body of the motor vehicle and consequently the prior art installation of a bifilar choking coil can be dispensed with.

Figure 9:
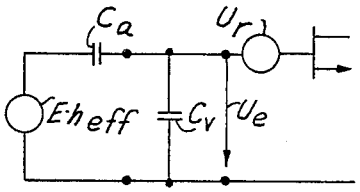
FIG. 9 is an equivalent circuit diagram of the active antenna of this invention for the reception of long-, medium- and short wave range.

In an active antenna according to this invention it is necessary, in order to optimize the long-medium-short wave range, to utilize a free area of the rear window which remains between the set of heating elements and the rim of the window. As a rule, this free area has a form of a rectangle with horizontally directed long sides and vertically directed narrow sides. At a given input capacity of the long-medium-short wave amplifying stage of the antenna system the optimization of the dimensioning of the corresponding antenna element mounted in this free area is made on the following principles:

In the long-medium-short range the antenna can be represented as a source with a capacitive internal resistance 1/Ca in series with a frequency independent source voltage $E.h_{eff}$. In disregarding the capacity of connectors between the antenna element and the input of the corresponding long-medium-short wave amplifying stage, the capacity of the antenna Ca is combined at the input 5 with the overall capacities Cv of the antenna amplifier as shown in FIG. 9. At a given internal noise voltage Ur of the amplifier, the required minimum field strength Eg for a signal-noise ratio of 1 is determined as follows:

$$Eg=(1+Cv/Ca)\cdot Ur/h_{eff} \quad (1)$$

For other field strengths E the resulting signal-noise ratio E/Eg can be represented as follows:

$$E/Eg=E\cdot h_{eff}/(Ur\cdot(1+Cv/Ca))=Ue/Ur \quad (2)$$

According to FIG. 9, Ue designates the input voltage of the long-medium-short wave amplifying stage at a given signal field strength E. In order to achieve a maximum sensitivity the limit field strength Eg is to be as small as possible or the control voltage Ue at a given field strength E should as large as possible. These requirements are met by selecting a maximum possible effective heighth $h_{eff}$ and a maximum possible capacity Ca at a minimum possible input capacity Cv.

In the following description the optimization of the sensitivity will be considered by the case of a set of heating elements which is grounded for long-medium-short wave range. In other words, the set of heating elements is directly connected to the direct current supply without any additional measures. The conductive boundary of the free area of the window which is not covered by the heating elements is therefore at the ground potential.

Figure 2:
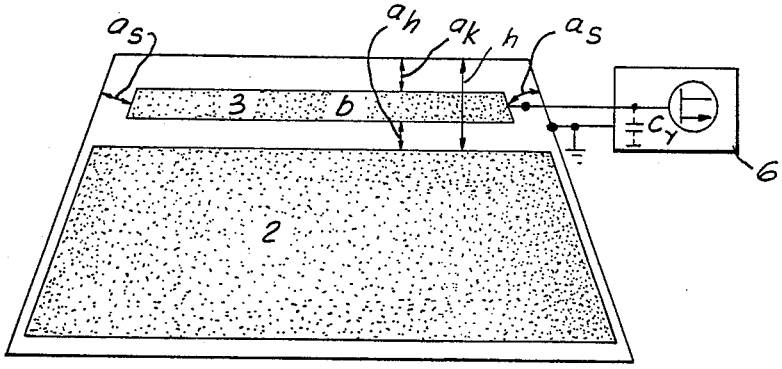
FIG. 2 illustrates schematically an arrangement of the flat antenna element for the reception of long, medium and short wave signals in a free window portion between the set of heating elements and the boundary conductor of the window.
Figure 10:
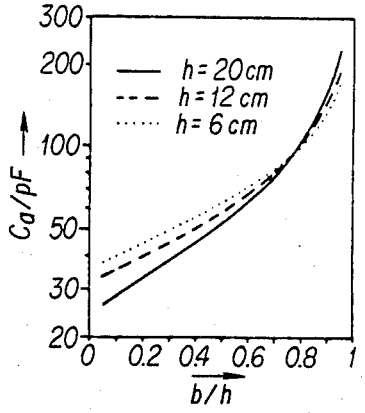
FIG. 10 is a plot diagram illustrating the relationship between the capacity Ca of the antenna and the relative width b/h of the flat antenna element for different clearances h of the free area on the window between the set of heating elements and a boundary conductor of the window.

A maximum effective heighth $h_{eff}$, because of symmetry, is achieved when the elongated flat antenna element in the free area in the window is situated at half the distance between the rim of the set of heating elements and the conductive rim of the window, in other words when the antenna element is located in the central region of the free area when the clearances ak and ah shown in FIG. 2 are equal or selected to equal a. Preferably, also the clearance or distance as between the narrow side of the flat antenna element 3 and the rim of the window is also equal to a. For the sake of a maximum capacity of the antenna of this invention the L-M-S antenna element mounted in the free window area has a flat configuration with a maximum width b and a miximum length h. This dependency of the antenna capacity Ca on the relative sides b/h of the antenna element is indicated in characteristic curves of FIG. 10 wherein the parameter h denotes, as indicated in FIG. 2, the width of the free area of the window between the rim of the set of heating elements and the opposite rim of the window, and the parameter b denotes a dimension resulting from b=(h−2a). In the plot diagram of FIG. 9 there are illustrated characteristic curves for three typical cases, namely for h=20 centimeters, h=12 centimeters and h=6 centimeters.

Figure 11:
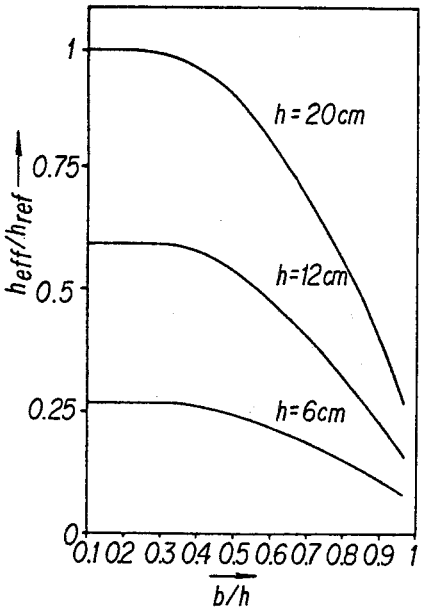
FIG. 11 is a plot diagram illustrating the relationship between the effective heighth $h_{eff}$ of the flat antenna element for the L-M-S-wave range to the relative width b/h for different clearances h of the free area in the window.

In contrast to the rise of the antenna capacity Ca, with increasing values of b/h the effective heighth h of the antenna structure decreases (measuring curves of FIG. 11). The reference heighth $h_{ref}$ in FIG. 11 is selected arbitrarily.

Figure 12:
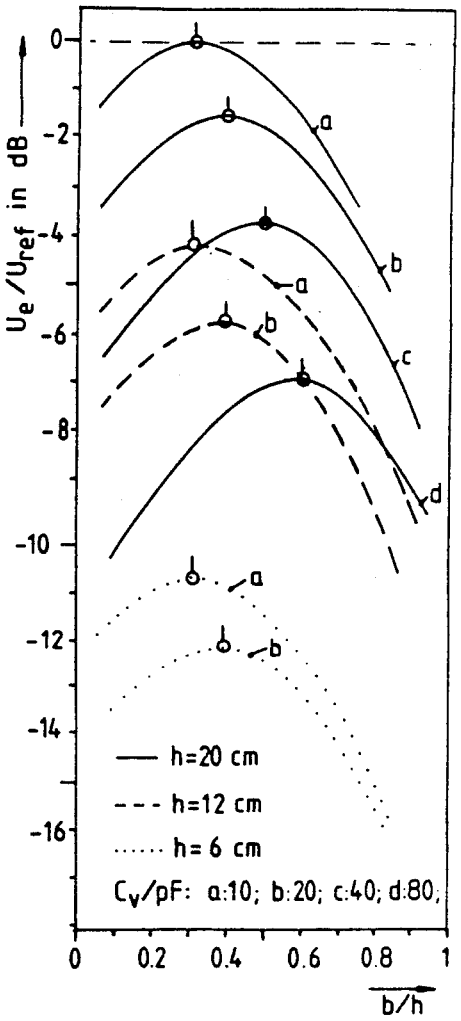
FIG. 12 is a plot diagram illustrating the relationship between the signal voltage $U_e$ at the input of the L-M-S amplifying stage and the relative width b/h of the flat antenna element for a grounded set of heating elements in the L-M-S range.

For a control voltage Ue at the input of the L-M-S antenna anplifier stage, there results from the afore described equation (2) relationships illustrated in FIG. 12. With increasing width h of the area of the window which is not covered by the set of heating elements the maximum achieveable control voltage also increases. Independently from the absolute value of the h there is always for the same value of b/h (b/h)opt a maximum control voltage $U_{emax}$. The value (b/h)opt depends on the input capacity Cv of the L-M-S wave stage of the antenna amplifier. The approximately parabolic characteristic of the course of Ue/Uref as a function of b/h can be described with a sufficient accuracy for the range of 5 pF less than Cv less than 100 pF, and 0.05 less than b/h less than 0.95, by the following equation:

$$Ue/Uemax(\text{in dB}) = \text{approximately} - 17.[b/h - 0.3 - 0.1 \cdot ld\,(Cv/10pF]^2 \quad (3)$$

wherein ld is a logarithm at the base of 2 and Uemax is a maximum value of each curve. In order to obtain this maximum, the expression b/h is to be dimensioned as follows:

$$(b/h)\text{opt} = \text{approximately } 0.3 + 0.1 \cdot ld\,(Cv/10pF) \quad (4)$$

Since b=h−2a, with the equation (4) the optimum clearance between the flat antenna element and the conductive boundary of the window can be expressed by the equation $$a_{opt} = \text{approximately } h/2 \cdot [0.7 - 0.1 \cdot ld\,(Cv/10\,pF)] \quad (5)$$

The dimensions of the set of heating elements and the position thereof in the rear window of the vehicle are determined by the design of the particular motor vehicle. As a rule, there remains only a narrow free area on the window surface which is available for mounting the L-M-S range antenna element. Accordingly, it is necessary to make use of the maximum dB value in order to improve the signal to noise ratio. To meet this requirement, apart from the optimization of the width b or of the clearance a in accordance with this invention it is also required to employ an antenna amplifier having a small total input capacity Cv and avoiding any additional capacitive loads. Accordingly, the connection conductors between the connection point on the L-M-S antenna element 4 and the input terminal of the L-M-S amplifying stage must be made as short as possible.

It will be seen from FIG. 12, with increasing width h of the free strip of the window between the set of heating elements and the rim of the window, which is available for the installation of the L-M-S wave antenna element, when optimized in accordance with this invention, the signal voltage Ue is increased and consequently the limit field strength Eg is reduced and accordingly a higher signal-noise distance in an actual reception is obtained. Therefore, for the sake of a high limit sensitivity, in rear windows of a motor vehicle in which a free strip is available both above and below a horizontally oriented set of heating elements, it is desirable to make the free area with an increased width h so as to install the L-M-S antenna element in accordance with this invention when the remaining longitudinal dimensions of the antenna and heating elements remain the same.

In practice the flat L-M-S antenna element can be realized for example by vaporizing on the free area of the window a thin metal layer which does not impair the transparency. In the constructions of the rear windows wherein the set of heating elements consists of thin heating wires sandwiched between two glass layers to produce a compound window pane, the flat antenna element according to this invention is also preferably embodied between the two glass layers and the strip-like configuration of the antenna element can be reproduced by a grid-like structure (FIG. 3*a*) or by an arrangement of several parallel wires (FIG. 3*b*) so as to obtain a maximum achieveable capacity of the antenna.

In a series production of heated rear windows for motor vehicles, there is employed a screen printing technology with a subsequent galvanic reinforcement of the applied conductors on a one-pane safety window. In these production steps the antenna according to this invention can be applied almost without any additional expenditures simultaneously with the application of the heating wires on the glass pane. As far as the electric behavior is concerned, the structure applied by the printing technology is equivalent to a wire structure of the same geometry.

Figure 3A:
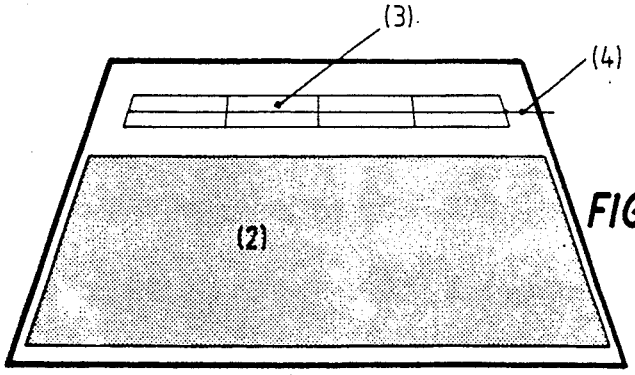
FIG. 3*a* illustrates an approximation of the flat antenna element for the long-, medium-, and short-wave range by a grid-like structure.
Figure 3B:
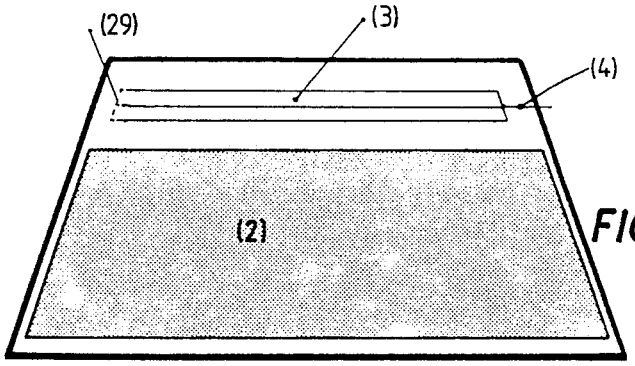
FIG. 3*b* represents the approximation of the flat antenna element of FIG. 3*a* by parallel conductors.

The horizontal dimension of conventional rear windows in passenger cars amounts approximately to one-half of the wave length for the ultra-short wave reception. Accordingly, for a long-medium-short wave antenna element according to FIG. 3*a*, provided that the connection point 4 is short-circuited with points 29 at the opposite window side (FIG. 3*b*) then in this embodiment there is a chance that ultra-short wave resonance currents in the L-M-S antenna element may negatively influence the effectiveness of the active antenna in the ultra-short wave range due to the resulting losses. Therefore it is advantageous to construct the antenna element 3 in the manner as illustrated in FIG. 3*b* in which the individual conductors are not conductively connected to the point 29 which is juxaposed to the connection point 4.

In comparison to the prior art antenna according to the German application P No. 26 50 044 the galvanic separation of the L-M-S antenna element from the set of heating wires produces a substantially reduced pick-up of interferences due to relatively small capacity between the set of heating elements and the antenna element. Accordingly, for filtering of frequencies in the long, medium and short wave range substantially smaller requirements are to be met in the direct current power supply than in prior art antennas of this kind. Consequently, the antenna of this invention saves on expenditures for the filtering devices.

Figure 4A:
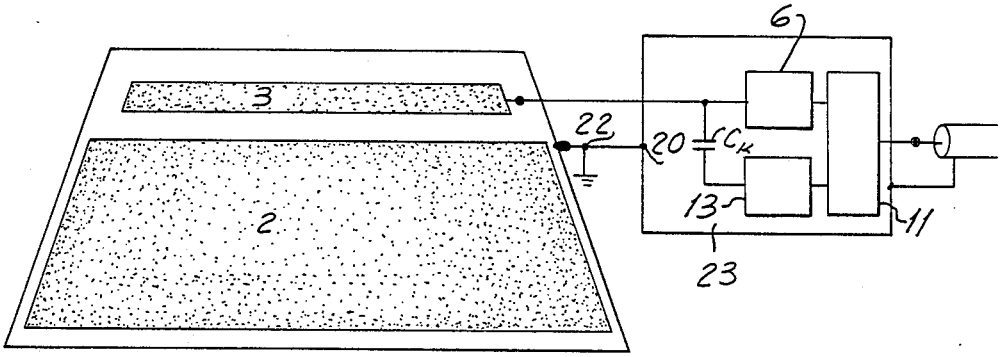
FIG. 4*a* shows an embodiment of the antenna of this invention in which ultra-short wave signals are coupled to the flat antenna element for L-M-S-wave signals by a capacitive coupling.
Figure 4B:
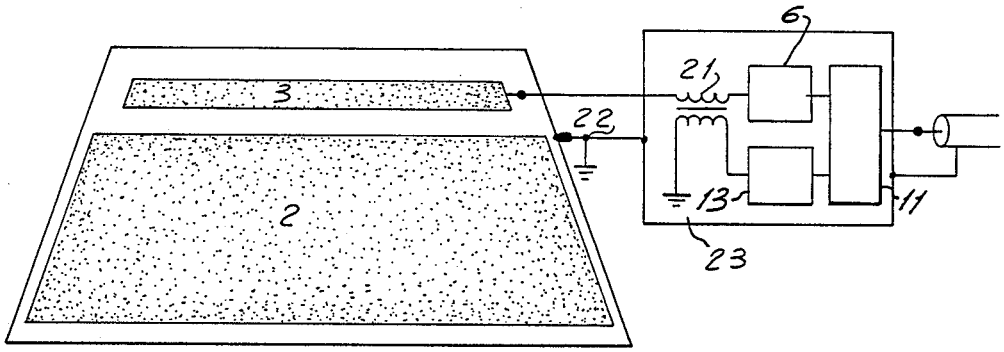
FIG. 4*b* is a modification of FIG. 4*a* wherein the ultrashort wave signals are coupled to the flat antenna element by an inductive coupling via a transformer.

The input of a separate amplifying stage 13 for very short wave length signals in the antenna of this invention is connected either to the connection point 19 on one of the bus bars of the set of heating elements 24 (FIG. 1) or the very short wave signal can be also coupled to the flat antenna element for L-M-S wave reception (FIGS. 4*a*, 4*b*). The common ground terminal 22 of the antenna amplifier 23 is to be connected to the conductive boundary of the rear window in close proximity to the connection point 19 or 4 so as to obtain well-defined impedances and quality in the ultra-short wave circuit.

In coupling the ultra-short wave amplifying stage 13 to the set of heating elements it is of advantage when the heating elements, due to the fact that they occupy a relatively large surface, be strongly coupled to the ultra-short wave field. Moreover, the input of the amplifier stage 13 should have a relatively low broad band impedance so as to ensure a loss-free transformation. The properties of the amplifier stage 4 contribute to better results in a high quality reception.

Figure 5A:
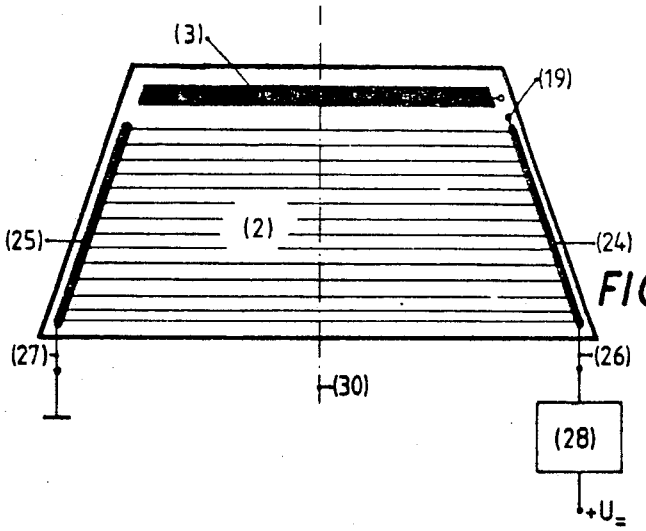
FIG. 5*a* shows the supply of direct current to the set of heating elements in the window via a reactive network connected to one bus bar of the set serving as an antenna element for the reception of ultra-short wave signals.
Figure 5B:
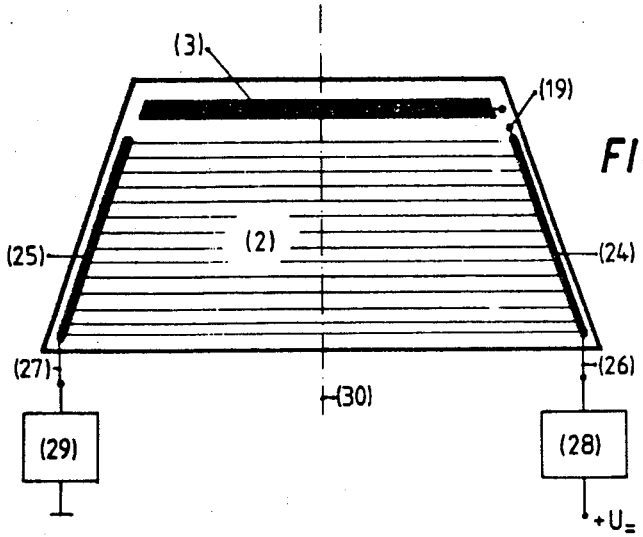
FIG. 5*b* shows a modification of FIG. 5*a* using a reactive network for both bus bars.

Referring to FIG. 5, the bus bar 24 is provided at one end thereof with a connection point 19 for the very short wave signal and at the opposite end thereof with a connection point for a direct current power supply to the heating wires 2. Due to the low impedance in the ultra-short wave range of the power supply, which is added parallel to the impedance of the heating elements, a considerable damping of the heating set results. Consequently, a noticeable loss of the heating-noise ratio is introduced. In order to improve the receiving quality of the antenna it is of advantage when the direct current power supply to the bus bar 24 is connected in series with reactance network or complex resistances which exhibit a high impedance for the very short wave range and a low resistance for the heating structure.

Figure 6A:
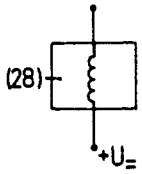
FIGS. 6*a*, 6*b* and 6*c* show schematically reactance circuits connected in series in the direct current power supply which exhibits high impedence in ultra-short wave range while permitting the passage of direct current.
Figure 6B:
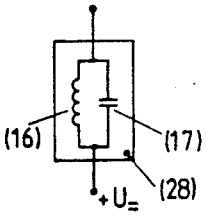
Figure 6C:
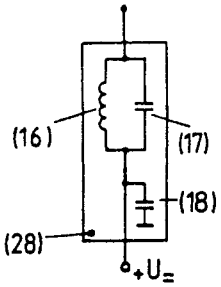
Figure 7:
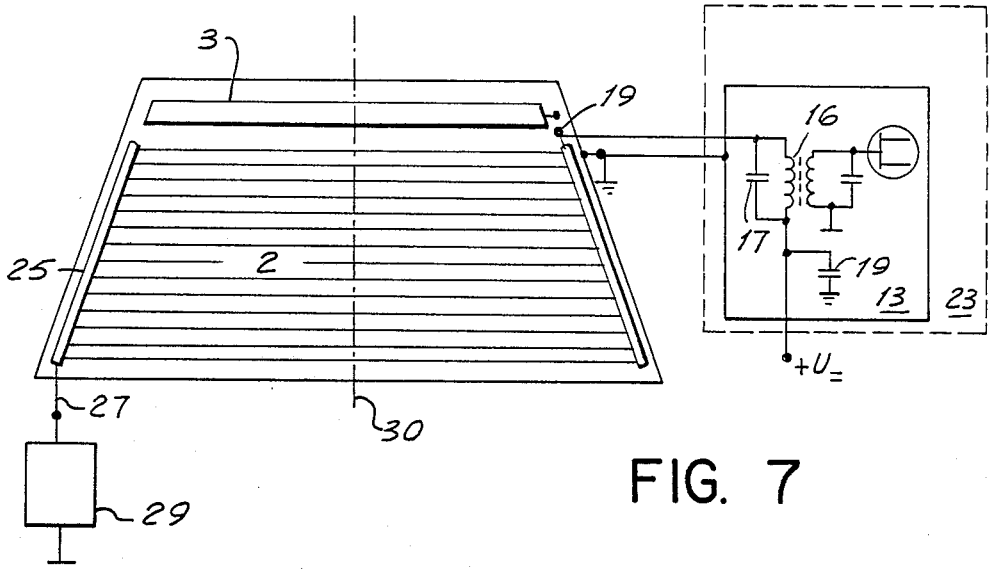
FIG. 7 shows in greater detail the amplifying stage for ultra-short wave signals including a transformer forming part of a reactive network for supplying direct current to the set of heating elements in the car window.

Examples of such high-ohmmic very short wave impedance circuits are illustrated in FIG. 6. FIG. 6*a* represents a series connected inductance. In this simple embodiment, there is necessary to employ a large number of windings of wires of a large diameter inasmuch as for relatively high power of 150–200 watts and in some cases up to 350 watts required for heating the rear window of a motor vehicle, the wire cross-section must be correspondingly increased in order to prevent intolerable losses on the heating efficiency. These requirements however lead to frequently unacceptable size of reactance coil.

It is therefore preferable to realize a high ultra-short wave impedance in such a manner that the reactance network includes a parallel resonance circuit in which the induction is substantially lower and accordingly the geometry of the coil 16, with the parallel connected capacitor 17 (FIG. 6*b*), can be correspondingly decreased. With advantage, the selected resonance frequency is the center frequency of the very short wave frequency band, so that an optimum decoupling of the antenna-heating elements from the direct current supply is obtained at a given inductivity. The reactance of the resonance circuit can be reduced so as to avoid damping of the ultra-short wave signal on the circuit and also to minimize the losses of the heating power.

In order to prevent disturbances in the reception on the very short wave frequency band due to interference signals which are super-imposed to the heating direct current, there may be necessary additional filtering measures in the direct current supply for the ultra-short wave range. In a simplest case, illustrated in FIG. 6*c*, the reactance circuit 28 including the parallel resonance circuit 16 and 17 further includes a capacitor 18 connected between the connection point of the supply of the parallel resonance circuit 16 and 17, and the ground so as to short-circuit the interference signal for the ultra-short wave band.

It has been found that if the reactance circuit 28 in the direct current supply is connected to one bus bar 24 only while the other bus bar has for alternating currents a low impedance connection to the ground, that the reception in the ultrashort wave band is frequently unsatisfactory. In a preferred embodiment of this invention, therefore, the other bus bar for supplying current to the heating elements is also connected to the current supply via an additional reactance network 29 (FIG. 5*b*) so that the average signal to noise distance is improved.

Preferably the additional reactance network 29 has the same construction as the corresponding network 28. Due to the relatively high ohmic impedance for the ultra-short wave band introduced in this manner to both branches of the direct current supply the entire set of heating elements is separated for alternating currents from the direct current supply.

In many instances it is also of advantage when for the sake a satisfactory signal and noise distance in an ultra-short wave signal band, the other bus bar 25 be not connected via a low impedance circuit for alternating currents to the ground potential or isolated for ultra-short wave signals. Instead, it is connected via a reactance network to the ground in such a manner that with a capacitive ultra-short wave impedence of the heated window the reactance circuit behaves as an inductance and in the case of an inductive ultra-short wave impedance of the window the circuit behaves as a capacitance so that the resulting circuit in the ultra-short wave range exhibits resonant properties.

The technological expenditures resulting from the necessity to employ one or two reactance networks in the direct current supply conduits for the set of heating elements can be avoided when the input of the ultra-short wave signal amplifier 13 is not connected to the bus bar for the heating element but is coupled to the flat antenna element for L-M-S wave range which is also excited by the ultra-short wave field. This coupling can be for example a capacitive one (FIG. 4*a*) whereby the unavoidable capacity Ck 20 connected parallel to the L-M-S-amplifying stage contributes to the increase of the overall capacity Cv of the amplifier. Therefore, this parallel capacity Ck 20 is to be held as low as possible in order to prevent the deterioration of the L-M-S reception.

This additional capacitive load of the L-M-S amplifying stage 6 can be avoided by using a transformer coupling to the ultra-short wave amplifying stage 13 (FIG. 4*b*). Consideration for designing such a coupling transformer 21 are disclosed for example in the German application P No. 23 10 616.

The employment of a flat antenna element 3 for the reception in the ultra-short wave range leads also to a satisfying reception provided that the transmitted ultra-short wave length signals are polarized horizontally and the receivingn antenna element is also polarized horizontally. In applications in which the transmitting antenna is circular or vertically oriented (USA), the antenna according to this invention yields markedly better reception with the coupling of the amplifying stage 13 for ultrashort wave lengths to the heating structure than with the coupling to the flat antenna element for the reception of L-M-S wave signals because the transverse dimensions of the latter antenna element are substantially smaller than those of the heating structure. In principle it has been found that for receiving vertical field components in the ultra-short wave length the antenna structures are more advantageous which have larger dimensions in vertical direction.

In a modification of this invention the stage 13 for ultra-short wave signals can be also exclusively a low-loss passive element which may also additionally include an active amplifying circuit.

In the preferred embodiment of this invention the ultra-short wave stage 13 in the antenna amplifier 23 is an active element which in comparison with an exclusively passive circuit has a substantially improved signal to noise ratio of the entire system. It is also necessary that the amplifying stages be matched to the inner impedence of the ultra-short wave antenna structure by means of a low-loss transforming circuit so as to optimize the signal to noise ratio and that the amplifier be situated in close proximity to the connection points to the antenna elements. This possibility of improving the average distance between the signal and noise is particularly advantageous when the operational efficiency of the passive antenna elements in comparison to a reference antenna, for example to a standard rod antenna, is not sufficient. A further low-loss transforming circuit at the output of the active element in the ultra-short wave signal stage 13 makes it possible to match efficiency in the ultra-short wave band to the characteristic impedence of the connection cable to the receiver.

In order to achieve an economic design, in the case of a satisfactory efficiency of the passive ultra-short wave antenna element it is advantageous when the signal stage 13 for ultra-short wave range is constructed exclusively of low-loss passive transforming elements to match the impedence of the ultra-short wave antenna structure to the characteristic impedence of the cable.

In the embodiment of the antenna of this invention in which for the reception both of the L-M-S wave signals and ultrashort wave signals a common flat antenna element 3 is used, the connection point 4 can be located at an arbitrary point of the antenna element, for example at the intersection of the antenna element 3 with a vertical axis of symmetry 30 of the conductive boundary of the window. As a rule, it is more advantageous when the connection point 4 is located at the right or left narrow side of the flat antenna element inasmuch as a shorter connection cable results and in addition in the proximity to the narrow sides of the antenna element a better accommodation of the antenna amplifier 23 in the frame of the car is possible (FIG. 2).

If for the reception of ultra-short wave signals the heating structure is employed as an antenna element, it is advantageous when the connection point 19 on the bus bar of the heating structure 2 and the connection point 4 on the flat antenna element 3 are situated in close proximity to the conductive rim of the window either at the left narrow side or at the right narrow side of the window pane (FIG. 1). In this manner short connections between the point 4 and the input of amplifying stage 6 or between the point 19 and the signal processing stage 13 are made possible. The amplifying stage 6 for L-M-S wave signals and the signal processing stage 13 for ultra-short wave signals are connected to corresponding inputs of a frequency separating circuit 11 whereby the circuits 6, 13 and 11 are preferably accommodated in a common housing of the antenna amplifier 23 and the common ground connection of the amplifier 23 is also preferably located in the proximity of connection points 4 and 19 at the conductive boundary of the window.

Figure 8:
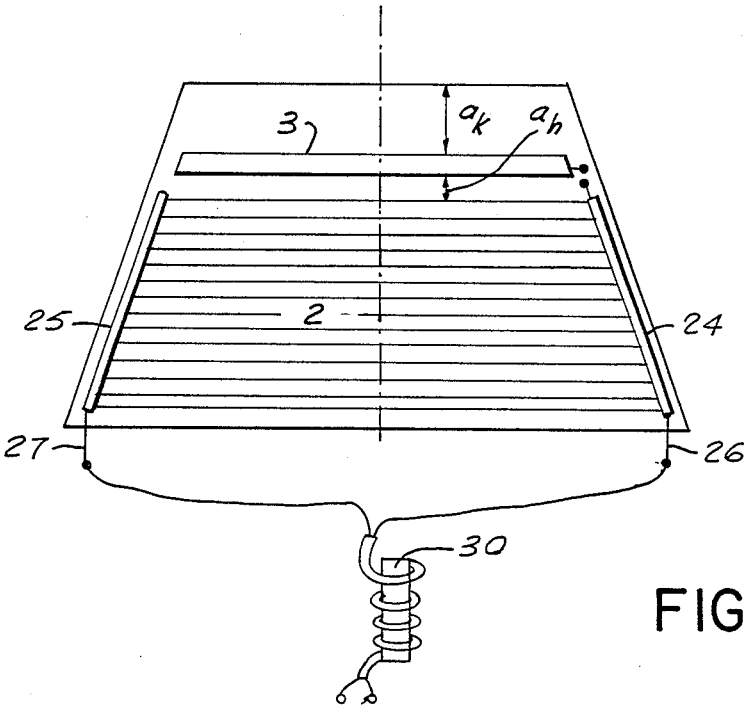
FIG. 8 illustrates schematically a circuit including a bifilar coil connected to the bus bars of the set of heating elements for separating direct current power supply from the high frequency signal range.

In many instances the distance between the heated field and the rim of the window is too small for obtaining a minimum field strength (FIG. 12). For example, a reduction in width h of the free strip-shaped area of the window from 20 centimeters to 6 centimeters even at the optimum dimensioning of the antenna element of this invention leads to a reduction of about 10.5 dB of the signal to noise ratio in the L-M-S wave range. In such cases an improvement of the limit sensitivity is achieved when the heating field is separated for high frequencies also in the L-M-S wave range from the direct current power supply in such a manner that a bifilar choke 30 is connected to the direct current supply wires (FIG. 8). In this embodiment the set of heating elements delivers a signal voltage at the L-M-S wave frequency with respect to the surrounding body of the motor vehicle. The equivalent circuit according to FIG. 9 of the antenna with the amplifier remains unchanged. The mininmum limit field strength Eg however is not obtained for the same clearances ak and ah (FIG. 2). Due to the contribution of the heating structure to the reception and its capacitive coupling to the L-M-S wave antenna element 3, a substantially smaller clearance ah to the heating field than the clearance ak to the conductive rim of the window is needed for achieving minimum field strength Eg or the maximum voltage $U_e$.

It will be understood that each of the elements described above, or two or more together, may also find a useful application in other types of constructions differing from the types described above.

While the invention has been illustrated and described as embodied in a heated rear window of a motor vehicle, it is not intended to be limited to the details shown, since various modifications and structural changes may be made without departing in any way from the spirit of the present invention.

Without further analysis, the foregoing will so fully reveal the gist of the present invention that others can be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An active antenna arranged in an electrically heated rear window of a motor vehicle to receive long-, medium-, short-, and ultra-short wave broadcasts, said rear window having a boundary conductor and a set of heating elements connected via bus bars to direct current power connections, said antenna comprising an elongated, flat antenna element arranged in the window on a free area between said set of heating elements and said boundary conductor to receive long-, medium-, and short wave signals;

an antenna amplifier including a linear amplifying stage having a capacitive input connected to said flat antenna element for processing long-, medium- and short-wave signals, a branch circuit for processing ultra-short wave signals having an input coupled to said set of heating elements in said window acting as an antenna element for the reception of said ultra-short wave signals, and a common ground terminal connected to said boundary conductor; and a frequency separating circuit having two inputs connected respectively to outputs of said amplifying stage and of said branch circuit to separate said long-, medium- and short-wave signals from said ultra-short wave signals and an output connected to a connector for an antenna cable.

2. An active antenna as defined in claim 1, wherein said input of the branch circuit is connected via coupling means to one of said bus bars, and said coupling means including a reactance circuit connected in series with a direct current power connection pertaining to said one bus bar.

3. An active antenna as defined in claim 2, wherein a second reactance circuit is connected in series with a direct current power connection pertaining to another bus bar.

4. An active antenna as defined in claim 2, wherein said input of the branch circuit is connected to one end of said one bus bar said reactance circuit having a high impedance in the ultra-short wave range as compared with the characteristic impedance of said antenna cable.

5. An active antenna as defined in claim 4, wherein said reactance circuit is an inductance connected in series with the direct current power supply connection.

6. An active antenna as defined in claim 4, wherein said high impedance reactance circuit for the ultra-short wave band includes a parallel resonance circuit connected between said one bus bar and said connection for the direct current supply, the parallel resonance circuit including a coil and a capacitor and having a resonance frequency in the ultra-short wave band to minimize the damping of the received signal in the entire ultra-short wave band.

7. An active antenna as defined in claim 6, wherein said resonance circuit further includes a filtering capacitor connected between ground and the connection point of said resonance circuit and the connection for the direct current power supply, said additional capacitor having an impedance which short-circuits the signals in the ultra-short wave range.

8. An active antenna according to claim 4, wherein the other bus bar with a corresponding direct current supply connection are grounded.

9. An active antenna as defined in claim 4, wherein the other bus bar is connected to the direct current power supply via another reactance circuit having a high impedance for ultra-short wave range as compared with the characteristic impedance of said antenna cable, so that the set of heating elements be separated from high frequency signals.

10. An active antenna as defined in claim 4, wherein in the case of a capacitive impedance of the set of heating elements in the ultra-short wave range the reactance circuit includes an inductor to produce a resonance condition in the ultra-short wave range.

11. An active antenna as defined in claim 4, wherein in the case of an inductive impedance of the set of heating elements in the ultra-short wave range said reactance circuit includes a capacitor to produce a resonance condition in the ultra-short wave range.

12. An active antenna as defined in claim 4, wherein said branch circuit for processing ultra-short wave signals is a reactive transforming circuit cooperating with said frequency separating circuit so as to match impedance of the antenna element for the ultra-short wave signal to an antenna cable at the output of said frequency separating circuit.

13. An active antenna as defined in claim 4, wherein said branch circuit for processing ultra-short wave signals is an amplifying stage including a reactive transforming circuit for coupling said amplifying stage to the antenna element for the ultra-short wave signals, and said frequency separating circuit including additional reactive circuit for matching the impedance to an antenna cable at the output of said frequency separating circuit.

14. An active antenna as defined in claim 2, wherein said means for coupling an input of said branch circuit includes a transformer and said reactance circuit including a winding of said coupling transformer.

15. An antenna as defined in claim 1, wherein the rear window has a substantially rectangular shape with horizontally oriented long sides, said set of heating elements being spaced apart about a distance h from one of said long sides to delimit said free area on the window for accommodating said elongated flat antenna element.

16. An active antenna as defined in claim 1, wherein said set of heating elements includes horizontally oriented heating wires delimiting a substantially rectangular free area with a clearance h to the opposite horizontal side of the window, said flat antenna element extending in the central region of said free area, the elongated sides of the flat antenna element being clear of said opposite horizontal side of the window and of the set of heating elements by distances ak and ah, the narrow sides of the flat antenna element being clear of the opposite vertical sides of the window by distances as, said distances being equal to each other and at a given input capacity Cv of the antenna amplifier in the range between 5 and 100 pF being approximately determined by the equation $$ak=ah=as=,\ a_{opt}=\text{approximately } h/2\cdot[0.7-0.1\cdot ld\ (Cv/10pF)]$$

wherein *ld* is a logarithm at the base of 2.

17. An active antenna as defined in claim 1, wherein said set of heating elements is arranged between the upper and lower sides of the window and said elongated flat antenna element being situated in a free area between the upper side of the window and said set of heating elements.

18. An active antenna as defined in claim 1, wherein the elongated flat antenna element is formed of a grid-like conductive structure.

19. An active antenna as defined in claim 1, wherein the elongated flat antenna element is assembled of a plurality of parallel elongated conductors interconnected at the ends thereof which are connected to the amplifier stage while the opposite ends of the parallel conductors are disconnected.

20. An active antenna as defined in claim 19, wherein the parallel conductors are applied on the window by a screen-printing process.

21. An active antenna as defined in claim 1, wherein said branch circuit for processing ultra-short wave signals has an input which is capacitively coupled to said elongated flat antenna element, said capacitive coupling having a relatively small capacity with respect to the input capacity Cv of the amplifier so as to avoid any impairment of reception in the L-M-S wave range due to excessive capacitive loads.

22. An active antenna as defined in claim 1, wherein said branch circuit for processing ultra-short wave signals has an input which is inductively coupled to said elongated flat antenna element via a transformer.

23. An active antenna as defined in claim 1, wherein said signal amplifying stage for the long-medium and short wave signal has its input connected to one of the narrow sides of said elongated flat antenna elements.

24. An active antenna as defined in claim 1, wherein a connection point of said elongated flat antenna element to an input of said signal amplifying stage for the long-medium-short wave signals and a connection of said antenna element for the ultra-short wave signals are arranged in close proximity to each other and to said boundary conductor.

25. An active antenna as defined in claim 1, further including a bifilar choke having a impedence for long-medium-short wave range and being connected to the direct current power connections, and a distance ah between the set of heating elements and the opposite side said of elongated flat antenna element being smaller than a distance ak between said boundary conductor and the facing long side of the flat antenna element so as to maximize the long-medium-short wave signal.

26. An antenna as defined in claim 1 wherein said elongated, flat antenna element has a transverse dimension b whose value is adjusted empirically so as to obtain an optimum signal.

* * * * *

UNITED STATES PATENT AND TRADEMARK OFFICE

CERTIFICATE OF CORRECTION

PATENT NO. : 4,791,426

DATED : December 13, 1988

INVENTOR(S) : H. Lindenmeier, et al.

It is certified that error appears in the above-identified patent and that said Letters Patent is hereby corrected as shown below:

Title page:

Item (75) inventors; third inventor should read --Jochen Hopf--.

Signed and Sealed this

Twenty-eighth Day of April, 1992

*Attest:*

HARRY F. MANBECK, JR.

*Attesting Officer*

*Commissioner of Patents and Trademarks*